United States Patent [19]

Rivera

[11] 4,371,992

[45] Feb. 8, 1983

[54] WATER FEEDER CONSERVATION TANK

[76] Inventor: Alfredo Rivera, 1266 Olmstead Ave., Apt. 2-F, Bronx, N.Y. 10462

[21] Appl. No.: 299,598

[22] Filed: Sep. 4, 1981

[51] Int. Cl.[3] ..... E03D 1/00

[52] U.S. Cl. ..... 4/353; 4/378; 4/410; 4/415

[58] Field of Search ..... 4/353, 363, 415, 365, 4/378–379, 410, 411, 413

[56] References Cited

U.S. PATENT DOCUMENTS

| | | | |
|---|---|---|---|
| 3,112,497 | 12/1963 | Call | 4/415 |
| 3,188,656 | 6/1965 | Drager | 4/415 |
| 3,318,449 | 5/1967 | Jennings et al. | 4/415 |
| 3,594,825 | 7/1971 | Reid | 4/415 |
| 3,995,327 | 12/1976 | Hendrick | 4/363 |
| 4,030,144 | 6/1977 | Aleman | 4/353 |
| 4,069,521 | 1/1978 | Aleman | 4/379 |
| 4,197,597 | 4/1980 | Toms | 4/415 |
| 4,297,751 | 11/1981 | Olin et al. | 4/415 |

*Primary Examiner*—Henry K. Artis
*Attorney, Agent, or Firm*—Richard L. Miller

[57] ABSTRACT

A water tank located above a conventional toilet tank so as to flow water downward into the toilet tank; the water tank including a drain pipe downward into the toilet tank, a hinged cover on top, and a mechanism to flow the water outward therefrom into the toilet tank.

2 Claims, 3 Drawing Figures

WATER FEEDER CONSERVATION TANK

This invention relates generally to toilet tank flushing systems.

BACKGROUND OF THE INVENTION

It is well known that conservation of the natural resources, such as water is urgently needed these days in view of the rising costs of fresh water being pumped to a house.

SUMMARY OF THE INVENTION

Accordingly it is a principal object of the present invention to provide a water storage tank into which water is placed that has already been used such as in a washing machine or bathtub so that such used water may be further re-used for flushing a toilet tank.

Another object is to provide a water conservation tank which is installed on top of a conventional toilet tank, and wherein the water automatically feeds from the water conservation tank and into the conventional toilet tank whenever the water level inside the toilet tank becomes lowered by the flushing action of the toilet.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The figures on the drawings are briefly described as follows.

DETAILED DESCRIPTION OF THE PREFERRED EMBODIMENT

Figure 1:
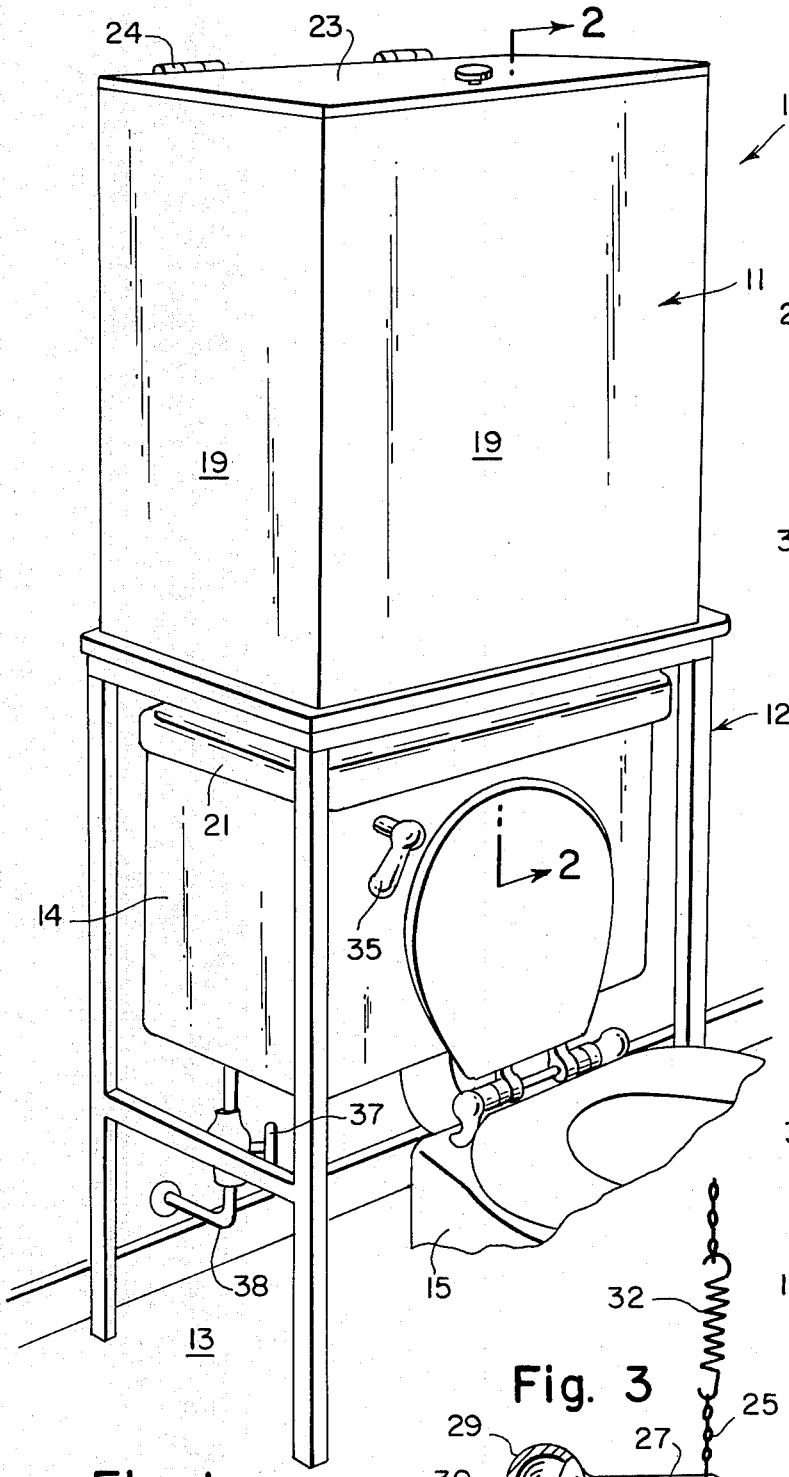
FIG. 1 is a front perspective view of the invention installed above a toilet tank.
Figure 2:
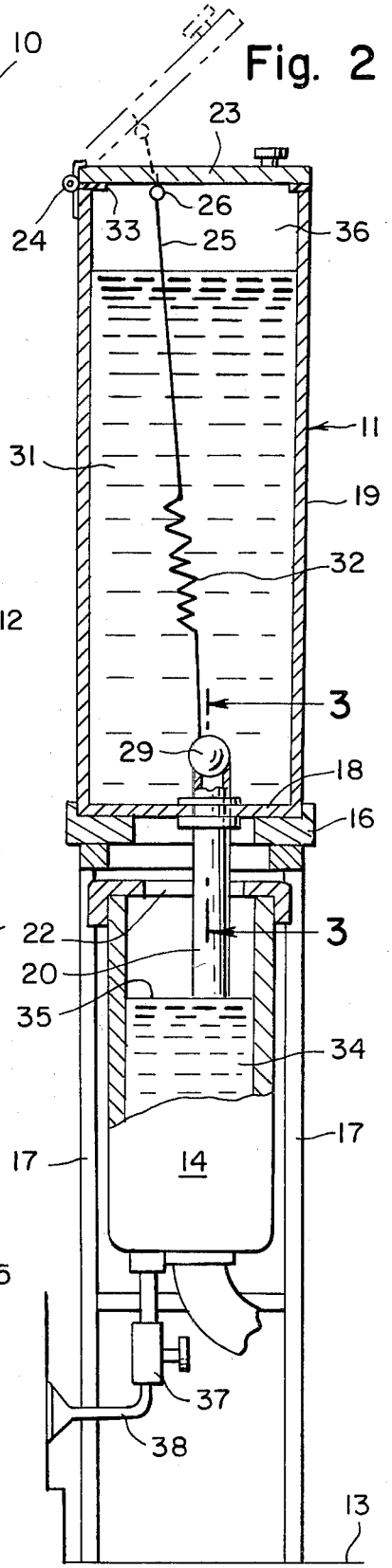
FIG. 2 is a cross-sectional view taken on line 2—2 of FIG. 1.
Figure 3:
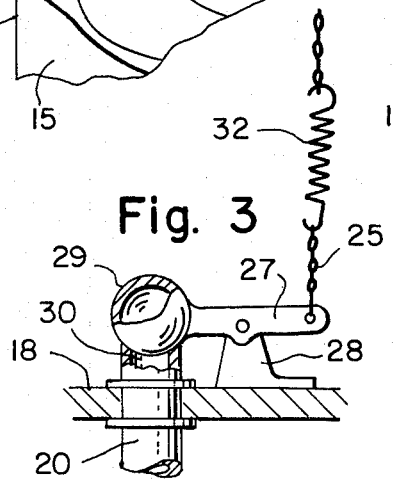
FIG. 3 is a cross sectional view taken on line 3—3 of FIG. 2.

Referring now to the drawing in greater detail, the reference numeral 10 represents a Water Feeder Conservation Tank, according to the present invention, wherein there is a tank member 11 placed upon a stand 12 which rests upon a washroom floor 13 and the tank member being located over a toilet tank 14 of a toilet 15.

The stand accordingly includes a horizontal frame 16 against which the edge of the tank bottom rests, and four downward legs 17 therefrom.

The tank member includes a bottom wall 18 and upward side walls 19 from the edges thereof. A drain pipe 20 extends downward through the bottom wall and its lower end protrudes downwardly inside the toilet tank 14.

Accordingly, the toilet tank 14 may either have its conventional lid completely removed therefrom, or else it may be replaced with a special lid 21 having a central hole 22 through which the drain pipe extends.

A cover 23 pivoted on hinges 24 selectively closes the opening at an upper end of the tank member 11. A flexible wire or chain 25 is connected at its one end to a hook 26 on an underside of the cover 23, and its lower end is connected to one end of a rocker arm 27 pivoted at its center on a bracket 28 installed upon an upper side of the tank bottom wall 18. An opposite end of the arm 27 has a hollow float ball 29 secured fixedly thereto and which seats upon the upper end of the drain pipe so as to selectively close the drain pipe opening 30 and prevent water 31 placed into the tank member from draining downward into the toilet tank.

The float ball, being hollow has a natural tendency to float upwardly off the drain pipe seat. A tension coil spring 32 is installed along the chain, so that when the cover 23 is pivoted upwardly into an open position, such as when pouring water into the tank member 11, the chain and spring pulling upwardly against one end of the arm 27, cause the float ball to remain seated on the drain pipe, so as to prevent water from flowing out of the tank member. When the cover is downwardly closed, the chain and spring relax so as to allow the flat ball to float up off the drain pipe seat. Thus water can flow out of the tank member whenever the toilet bowl is flushed.

A gasket 33 around an upper edge of the tank member insures an air-tight seal when the cover is closed so as to form a low air pressure area 36 inside the tank member, over the water 31 when some of the water is outwardly drained from the tank member.

In order that the present invention is used, as intended, the valve 37 on a fresh water supply line 38 may be shut off, so that turning the handle 35 serves only to flush the water 34 from the toilet tank into the toilet bowl, and not to refill the toilet tank with a fresh water supply.

When the water 34 is thus drained out of the toilet tank, the water level 35 thus drops lower than a lower end of the drain pipe 20, thus automatically causing the water 31 from the tank member 11 to drain into the toilet tank until the water level is again restored at a lower end of the drain pipe.

Recycling water from a bathtub, washing machine or the like is placed into the tank member 11 by simply lifting the cover 23 and pouring the water therein.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

I claim:

1. A water feeder conservation tank, comprising, in combination, a tank member on a table and installed over a conventional toilet tank of a toilet, a drain pipe through a bottom wall of said tank member extending downward into said toilet tank, a hinged cover on a top of said tank member, an air-tight gasket between the edges of said cover and the edges of an opening in said tank member top and a float ball mechanism on a top of said drain pipe; said float ball mechanism being controlled by a chain attached to said hinged cover, a tension spring intercepting said chain, said float ball mechanism comprising a float ball receivable over a top opening of said drain pipe, said float ball being on one end of a rocker arm centrally pivotable about a stationary pin of a bracket installed upon said tank member bottom wall while said chain is attached to an opposite end of said rocker arm so that said float ball is urged against said drain pipe by said spring when cover is upwardly pivoted, thereby preventing any water from entering said drain pipe while said cover is in an upwardly opened position.

2. The combination as set forth in claim 1, wherein said water feeder conservation tank includes a replaceable cover for said toilet tank, providing a hole for said drain pipe.

* * * * *